United States Patent [19]

Zorev et al.

[11] 4,072,509

[45] Feb. 7, 1978

[54] STEEL FOR NUCLEAR APPLICATIONS

[76] Inventors: Nikolai Nikolaevich Zorev, ulitsa Novinki, 6, kv. 23; Anatoly Alexandrovich Astafiev, Sharikopodshipnikovskaya ulitsa, 2, kv. 34; Alexandr Sergeevich Loboda, Otkrytoe shosse, 6, korpus 3, kv. 48; Vladimir Pavlovich Savukov, Simonovsky val, 19, kv. 21; Andrei Efimovich Runov, Zatonnaya ulitsa, 17, kv. 51, all of Moscow; Vladimir Alexandrovich Belov, Kolpino, ulitsa Very Slutskoi, 9, kv. 20, Leningrad; Jury Vasilievich Sobolev, prospekt Lenina, 10, kv. 10, Leningrad; Valentin Vasilievich Sobolev, Kolpino, ulitsa Pavlovskaya, 84, kv. 43, Leningrad; Nikolai Mikhailovich Pavlov, Kolpino, ulitsa Gromova, 16, kv. 50, Leningrad; Boris Evgenievich Paton, ulitsa Chkalova, 41a, kv. 26; Boris Izrailevich Medovar, ulitsa Anri Barbjusa, 22/26, kv. 109, both of Kiev; Jury Fedorovich Balandin, ulitsa Basseinaya, 117, korpus 1, kv. 35, Leningrad; Igor Vasilievich Gorynin, ulitsa Gromova, 16, kv. 50, Leningrad; Jury Ivanovich Zvezdin, Kostromskoi prospekt, 42, kv. 23, Leningrad; Kuzma Makeevich Ivanov, Nevsky prospekt, 175, kv. 3, Leningrad; Viktor Alexandrovich Ignatov, ulitsa Sofii Kovalevskoi, 10, korpus 2, kv. 169, Leningrad; July Georgievich Emelyanenko, ulitsa Darvina, 5, kv. 5, Kiev, all of U.S.S.R.

[21] Appl. No.: 756,972

[22] Filed: Jan. 5, 1977

[51] Int. Cl.[2] ..... C22C 38/42

[52] U.S. Cl. ..... 75/124; 75/125; 75/128 N; 75/128 V; 75/128 W; 75/128 R; 176/88

[58] Field of Search ..... 75/125, 124, 128 P, 75/128 N, 128 W, 128 V, 128 R; 148/36; 176/88

[56] References Cited

U.S. PATENT DOCUMENTS

| | | | |
|---|---|---|---|
| 3,403,060 | 9/1968 | Ito et al. | 75/124 |
| 3,424,576 | 1/1969 | Fogelman et al. | 148/36 |
| 3,733,195 | 1/1970 | Nishi et al. | 75/125 |
| 3,929,472 | 12/1975 | Okada et al. | 75/124 |

FOREIGN PATENT DOCUMENTS

| | | | |
|---|---|---|---|
| 1,584,607 | 11/1969 | France | 148/36 |

OTHER PUBLICATIONS

Hawthorne, "Trends in Charpy -V-Shelf Energy Degradation and Yield Strength Increase of Neutron-Embrittled Pressure Vessel Steels", Nuc. Eng. & Des. 11 (1970) pp. 427–446.

Potapovs, "The Effect of Residual Elements on the Response of Selected Pressure-Vessel Steels and Weldments to Irradiation at 550° F", Nuc. App. vol. 6, 1969, pp. 27–46.

*Primary Examiner*—Arthur J. Steiner

*Attorney, Agent, or Firm*—Steinberg & Blake

[57] ABSTRACT

A steel contains, in percent by weight:

carbon from 0.13 to 0.18
silicon from 0.17 to 0.37
manganese from 0.30 to 0.60
chromium from 1.7 to 2.4
nickel from 1.0 to 1.5
molybdenum from 0.5 to 0.7
vanadium from 0.05 to 0.12
aluminium from 0.01 to 0.035
nitrogen from 0.05 to 0.012
copper from 0.11 to 0.20
arsenic from 0.0035 to 0.0055
iron and impurities — the balance.

This steel is preferable for use in the manufacture of nuclear reactors.

1 Claim, No Drawings

STEEL FOR NUCLEAR APPLICATIONS

The present invention relates to metallurgy, and more particularly to the production of steels which can be used in the nuclear power engineering for manufacturing nuclear reactors and other pressure vessels exposed to irradiation and having wall thicknesses of up to 650 mm.

U.S. Pat. No. 3,424,576 discloses a steel which contains in percent by weight:

carbon from 0.13 to 0.65
silicon from 0.1 to 0.5
manganese from 0.45 to 1.2
chromium up to 1.5
nickel up to 2.0
molybdenum from 0.05 to 0.6
vanadium or
niobium or
tantalum from 0.01 to 0.15
lead from 0.05 to 0.35
phosphorus up to 0.04
sulfur up to 0.05
iron — the balance.

The steel of the patent referred to above can be used for manufacturing nuclear reactors of a medium capacity.

However, due to the fact that this steel has a low hardenability and its impact strength is not high, it cannot be used for making large-size articles with a great wall thickness.

U.S.S.R. Inventor's Certificate No. 441,338 discloses a steel containing, in percent by weight:

carbon from 0.13 to 0.18
silicon from 0.17 to 0.37
manganese from 0.3 to 0.55
chromium from 1.0 to 1.5
nickel from 1.0 to 1.6
molybdenum from 0.51 to 0.70
vanadium from 0.01 to 0.1
copper not more than 0.2
cerium from 0.002 to 0.04
iron and impurities — the balance.

This steel has a good weldability and plasticity and, therefore, can be used for making nuclear reactors of a medium capacity.

However, the aforesaid steel has an insufficient hardenability, strength and temperature of brittle-viscous transition as applied to welded articles having a wall thickness of up to 650 mm. Since there is no steel having an increased hardenability, a sufficiently low critical temperature of brittleness, and a small shift of the critical temperature of brittleness after irradiation, this involves considerable difficulties in manufacturing powerful nuclear reactors.

It is a principal object of the invention to produce a steek having a lower critical temperature of brittleness (up to −100° C) in thickness of up to 650 mm as against those steels used in the manufacturing of reactors.

Another important object of the invention is to attain a small shift of the critical temperature of brittleness after neutron irradiation.

It is still another object of the invention to attain a deep hardenability of the steel combined with a high strength thereof.

These and other objects of the invention are accomplished by producing a steel which contains carbon, silicon, manganese, chromium, nickel, molybdenum, vanadium, copper and iron wherein, according to the invention, there included additionally aluminium, nitrogen, and arsenic, said components being contained in the following amounts, in percent by weight:

carbon from 0.13 to 0.18
silicon from 0.17 to 0.37
manganese from 0.30 to 0.60
chromium from 1.7 to 2.4
nickel from 1.0 to 1.5
molybdenum from 0.5 to 0.7
vanadium from 0.05 to 0.12
aluminium from 0.01 to 0.035
nitrogen from 0.005 to 0.012
copper from 0.11 to 0.20
arsenic from 0.0035 to 0.0055
iron and impurities — the balance.

The additional amount in the steel of aluminium from 0.01 to 0.035 percent by weight and nitrogen from 0.005 to 0.012 percent by weight leads, as a result of their interaction, to the formation of nitrides which are conducive to the grain size reduction which increases the impact strength of the steel, especially at minus temperatures and after strain ageing, as well as reduces the temperature of brittle-viscous transition of the steel. This improves the reliability and extends the service life of the powerful nuclear engineering equipment.

The increase of the amount of aluminium over and above said amount leads to increased contamination of the metal with alumina as well as to dissolution in the steel of aluminium in a free state which lowers the impact strength, especially at minus temperatures and increases the temperature of the brittle-viscous transition.

The lowering of the amount of aluminium to less than 0.01 percent by weight reduces the deoxidation and decontamination of the herein proposed steel.

It is undesirable to increase the amount of nitrogen above said amount since this will facilitate the contamination of the metal with nitrides and the lowering of the resistance of the steel to brittle fracture, whereas the lowering of the amount of nitrogen to less than 0.005 percent by weight is inefficient since it will lead to lower formation of highly-dispersed nitride phases.

The additional amount of arsenic from 0.0035 to 0.0055 percent by weight with the amount of copper from 0.11 to 0.20 percent by weight makes it possible to smelt steel with conventional charge materials according to the known methods so that high technological properties and service qualities of the metal are obtained.

The lowering of the amount of arsenic to less than said amount is inefficient in that it complicates steel-smelting processes whereas the increase in the amount of arsenic above 0.0055 percent by weight may adversely affect the irradiation resistance and purity of the steel.

The amount of chromium from 1.7 to 2.4 percent by weight in the steel improves its hardenability, and makes it possible to achine uniformity of strength and plasticity properties in thicknesses of up to 650 mm, improve the impact strength and reduce the brittle-viscous transition temperature.

The lowering of the amount of chromium to less than 1.7 percent by weight does not make it possible to obtain the required complex of mechanical properties of the steel, above all the strength characteristics and low critical temperature of brittleness; the increase of the amount of chromium in the steel to more than 2.4 percent by weight is not advisable since in this case complex carbides may be formed thereby to result in a lowering of the impact strength and resistance.

The amount of chromium of up to 2.4 percent by weight in combination with nickel and molybdenum makes it possible to considerably improve the strength of the steel. For this purpose nickel is added to the steel along with chromium, in the amount of from 1.0 to 1.5 percent by weight, and molybdenum from 0.5 to 0.7 percent by weight.

Said amount of carbon from 0.13 to 0.18 percent by weight makes it possible to produce a steel of increased strength without lowering the critical temperature of brittleness and deteriorating the technological properties of forgings with a thickness of up to 650 mm.

The amount of silicon in the steel within the above limits ensures its complete deoxidation and the obtaining of a solid casting.

The increase of the amount of silicon in the steel to more than 0.37 percent by weight may result in its contamination with matallic inclusions and lower impact strength thereof.

The amount of vanadium from 0.05 to 0.12 percent by weight enables the production of steel with a fine-grain structure, which increases the impact strength and decreases the brittle-viscous fracture temperature thereof.

The basic component of the steel is iron, and in addition to said alloying components it contains impurities, in percent by weight: sulfur up to 0.02, and phosphorus up to 0.02.

The steel, according to the invention, can be most effectively used for making powerful bodies of nuclear reactors.

For an explanation of theinvention presented below are tentative compositions of the steel with reference to the accompanying table.

The steel, according to the invention, is smelted in electric-arc and open-hearth furnaces by the known smelting methods. Deoxidation of the steel is effected with materials conventionally employed in metallurgy.

EXAMPLE 1

The steel contains, in percent by weight:
carbon 0.18
silicon 0.26
manganese 0.45
chromium 1.89
nickel 1.33
molybdenum 0.56
vanadium 0.10
aluminium 0.02
nitrogen 0.008
copper 0.13
arsenic 0.004
iron and impurities— the balance.

Said composition ensures the production of a steel which has an ultimate strength of not less than 63.0 kg/mm$^2$ and a yield point of not less than 55.3 kg/mm$^2$ at a working temperature of 350° C. The characteristics of the relative elongation and relative contraction of steel have high values and are respectively from 16.4 to 19.2% and from 71.0 to 73.5%. The impact strength of the steel retains high values in the process of testing at minus temperatures and is from 13.0 to 19.4 kgm/cm$^2$ at −20° C.

EXAMPLE 2

The steel contains, in percent by weight:
carbon 0.16
silicon 0.21
manganese 0.35
chromium 1.76
nickel 1.37
molybdenum 0.53
vanadium 0.07
aluminium 0.03
nitrogen 0.006
copper 0.11
arsenic 0.005
iron and impurities — the balance.

The steel of said composition has an ultimate strength of not less than 60.0 kg/mm$^2$ and a yield point of not less than 51.8 kg/mm$^2$ in the process of tensile tests at 350° C. The relative elongation of the steel is from 16.0 to 18.0% and the relative contraction from 70.4 to 71.0%. The impact strength of the steel in notched Charpy specimens in the process of testing at −20° C is from 19.8 to 22.0 kgm/cm$^2$, and at −50° C from 12.2 to 19.0 kgm/cm$^2$.

EXAMPLE 3

The steel contains, in percent by weight:
carbon 0.16
silicon 0.22
manganese 0.38
chromium 2.30
nickel 1.32
molybdenum 0.57
vanadium 0.10
aluminium 0.01
nitrogen 0.005
copper 0.16
arsenic 0.0055
iron and impurities — the balance.

The ultimate strength of the steel of said composition at a temperature of testing of 350° C varies from 59.5 to 60.5 kg/mm$^2$ and the yield point varies from 51.8 to 53.6 kg/mm$^2$. The relative elongation of the steel is from 15.2 to 16.4% and the relative contraction from 72.0 to 75.0%. The impact strength of the steel in the process of testing at +20° C is from 23.7 to 26.2 kgm/cm$^2$ and at −20° C from 12.4 to 16.8 kgm/cm$^2$.

The mechanical properties of the steel according to the invention are presented in the accompanying table as compared with the steel of the known composition.

To compare the mechanical properties under the same conditions of heat treatment and with the same thickness of forgings (330mm), the following chemical composition of the steel has been selected.

EXAMPLE 4

The steel contains, in percent by weight:
carbon 0.17
silicon 0.26
manganese 0.45
chromium 1.74
nickel 1.35
molybdenum 0.57
vanadium 0.10
aluminium 0.02
nitrogen 0.007
copper 0.12
arsenic 0.0038
iron and impurities — the balance.

The proposed steel as compared with the known steel under the same testing conditions and with practically equal characteristics of plasticity has improved strength characteristics ultimate strength of the proposed steel at +20° C is from 69.2 to 71.0 kg/mm², and the known steel from 65.6 to 67.9 kg/mm²; the yield point of the proposed steel is from 57.7 to 62.2 kg/mm² and that of the known steel is from 49.3 to 54.6 kg/mm². The impact strength in Charpy tests in notched specimens at +20° C in the proposed steel is from 26.3 to 27.5 kgm/cm², and in the known steel from 16.7 to 18.0 kgm/cm²; at −20° C in the proposed steel it is respectively from 20.0 to 23.4 kgm/cm² and in the known steel from 2.4 to 11.6 kgm/cm². The proposed steel has an impact strength of up to 9 kgm/cm² at a temperature of testing of −100° C.

Table

| Steel | Exam No. | Temp. of test, ° C | Ult, str., kg/mm² | Yield point kg/mm² | Rel. elong. % | Rel. contr. % | Impact strength, kgm/cm² (notched Charpy specimens) Test temperature, ° C +20 | 0 | −5 | −20 | −35 | −50 | −80 | −100 |
|---|---|---|---|---|---|---|---|---|---|---|---|---|---|---|
| | | | Mechanical properties of articles from the proposed and the known steel | | | | | | | | | | | |
| Proposed Steel | 7 | 20 | 73.3/74.6 | 62.8/64.4 | 22.0/23.4 | 74.6/78.7 | 23.2/26.1 | — | 16.4/19.4 | 13.0/19.6 | 14.7/19.6 | 8.8/19.6 | — | — |
| | | 350 | 63.0/63.5 | 55.3/55.6 | 16.4/19.2 | 71.0/73.5 | | | | | | | | |
| | 2 | 20 | 70.6/72.6 | 61.0/63.0 | 21.0/24.0 | 74.7/75.6 | 20.2/24.0 | — | 19.8/22.0 | 9.4/21.0 | 11.8/21.4 | 12.2/19.0 | — | — |
| | | 350 | 60.0/61.2 | 51.8/53.6 | 16.0/18.0 | 70.4/71.0 | | | | | | | | |
| | 3 | 20 | 70.2/70.7 | 59.8/61.0 | 20.0/20.3 | 75.4/75.4 | 23.7/26.2 | — | — | 12.4/16.8 | — | — | — | — |
| | | 350 | 59.5/60.5 | 52.0/53.0 | 15.2/16.4 | 72.0/75.0 | | | | | | | | |
| | 4 | 20 | 69.2/71.0 | 57.7/62.2 | 24.0/25.0 | 77.0/79.3 | 26.3/27.5 | 21.6/25.0 | — | 20.0/23.4 | — | 15.8/23.0 | 9.5/10.4 | 3.1/9.0 |
| | | 350 | 57.8/61.3 | 48.8/53.0 | 17.0/19.2 | 74.6/76.2 | | | | | | | | |
| Known steel | — | 20 | 65.6/67.9 | 49.3/54.6 | 20.0/20.3 | 76.6/77.8 | 16.7/18.0 | 13.0/23.0 | — | 2.4/11.6 | — | — | — | — |
| | | 350 | 56.3/57.1 | 41.7/47.0 | 19.0/19.3 | 74.2/75.8 | | | | | | | | |

The proposed steel has a high impact strength after heat and strain ageing, and a low sensitivity to strain concentrators.

The good technological properties of the steel in welding are characterized by the impact strength of the metal in the weld zone which is from 8 to 9 kgm/cm² without tempering at a temperature of −20° C. The proposed steel ensures complete absence of cracks in the weld zone in large-size units at a temperature of preheating for welding from 150° to 200° C.

The proposed steel has alow shift of the critical temperature of brittleness due to irradiation. At a temperature of irradiation from 260 to 320° C with a neutron flow of $1.3 \times 10^{20}$ N/cm² and an energy of E>0.5 MeV, the increase of the critical temperature of brittleness is from 70° to 80° C.

The steel has been tested in industrial conditions and its properties have been fully investigated in forgings, rolled stock and joints welded by automatic flux welding, hand arc welding and electric slag welding. The proposed steel and its welded joints feature high cyclic strength under all the testing conditions, and stable characteristics of heat resistance and brittle strength.

The comprehensive investigation conducted with regard to studying all the service qualities of the steel characterized it as a material having high technological properties, fit for in nuclear power machine building for making powerful nuclear reactors and other pressure vessels exposed to irradiation.

What is claimed is:

1. A steel consisting essentially of in percent by weight:

carbon from 0.13 to 0.18,
silicon from 0.17 to 0.37,
manganese from 0.30 to 0.60,
chromium from 1.7 to 2.4,
nickel from 1.0 to 1.5,
molybdenum from 0.5 to 0.7,
vanadium from 0.05 to 0.12,
aluminium from 0.01 to 0.035,
nitrogen from 0.005 to 0.012,
copper from 0.11 to 0.20,
arsenic from 0.0035 to 0.0055,
iron and impurities — the balance.

* * * * *